United States Patent [19]

Granström et al.

[11] Patent Number: 4,571,126

[45] Date of Patent: Feb. 18, 1986

[54] EXPANSION BODY

[75] Inventors: Bengt P. O. Granström, Bromma; Bo T. Skogberg, Handen, both of Sweden

[73] Assignee: Atlas Copco Aktiebolag, Nacka, Sweden

[21] Appl. No.: 560,124

[22] Filed: Dec. 12, 1983

[30] Foreign Application Priority Data

Dec. 21, 1982 [SE] Sweden ..... 8207291

[51] Int. Cl.[4] ..... E02D 5/28; E02D 5/76

[52] U.S. Cl. ..... 405/244; 405/237

[58] Field of Search ..... 405/234, 237, 244, 259, 405/260; 52/155

[56] References Cited

U.S. PATENT DOCUMENTS

| | | | |
|---|---|---|---|
| 2,631,435 | 3/1953 | Emshwiller | 405/244 |
| 4,423,986 | 1/1984 | Skogberg | 405/259 |
| 4,487,528 | 12/1984 | Skogberg | 405/259 |

FOREIGN PATENT DOCUMENTS

| | | | |
|---|---|---|---|
| 951479 | 10/1949 | France | 405/237 |
| 52426 | 4/1980 | Japan | 405/237 |
| 880736 | 10/1961 | United Kingdom | 405/237 |
| 861471 | 9/1981 | U.S.S.R. | 405/234 |

*Primary Examiner*—David H. Corbin

*Attorney, Agent, or Firm*—Frishauf, Holtz, Goodman & Woodward

[57] ABSTRACT

An expansion body for constructions like piles or anchorages located in the earth is adapted for insertion into the ground in a compact shape and expanded therein to an expanded shape. The expansion is achieved by unfolding a folded metallic casing (11) by filling it up with pressurized fluid. Each end of the elongated body is sealed by a closure comprising a socket (16, 17) with a sleeve (18, 19) encircling the near end part of the casing and a bottom plate (20, 21) with spacing means (22, 23) projecting into the inside of the casing. The sleeve (18, 19) and spacing means (22, 23) define an annular space (26, 27) in which the end parts (14, 15) are kept in a folded position when the body is expanded.

9 Claims, 9 Drawing Figures

EXPANSION BODY

BACKGROUND OF THE INVENTION

This invention relates to an expansion body for constructions located in the earth including a folded elongated casing and a first and a second closure arranged at the upper and lower end respectively of the casing, said casing and closures defining an internal closed space connectable to a source of pressurized fluid for the expansion of the body by pressing out the folds of the casing.

Expansion bodies of the kind mentioned above have been proposed for in situ piles and especially as an expanded foot of these. When such piles are used, the casing is first inserted into the ground and then filled with pressurized water or concrete for pressing out the folds thereof thus giving the pile its final shape.

A problem related to expansion bodies of that kind has been the arrangement of the end closures. The reason for this is that said closures must be designed for sealing the end parts of the casing as well as for enabling the foldings to unfold gradually from the ends without causing cracking tensions in the casing. According to one known proposal for such an expansion body, the closures are shaped like cone-formed endings of the casing with successively decreasing depths of the foldings. Closures like that are, however, in practice impossible to manufacture for a reasonable cost. They are also unsuitable for closely folded casings or when there is a need for larger inlets or tubes leading through the casing.

An object of the present invention is to provide an expansion body with end closures which eliminate the drawbacks mentioned above. Another object is to provide an end closure which is simple and cheep to manufacture and mount on the ends of the casing.

These objects and others are achieved by providing an expansion body according to the accompanying claims.

DETAILED DESCRIPTION

Figure 1:
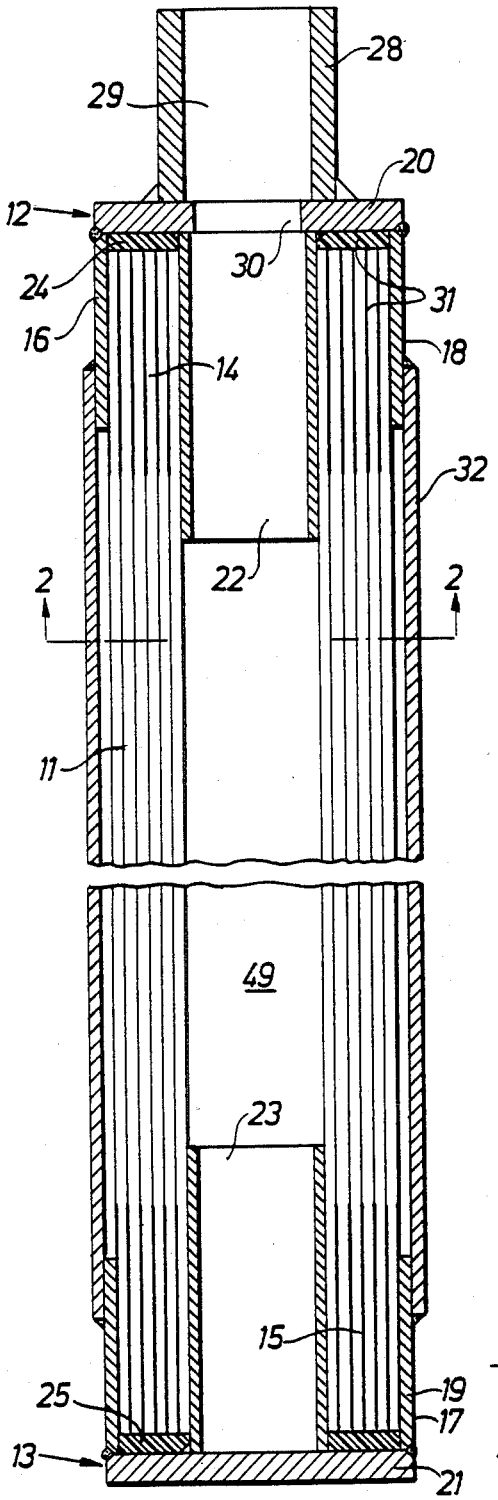
FIG. 1 is a longitudinal cross section of an expansion body according to the invention. The section is taken along the line 1—1 in FIG. 2.
Figure 2:
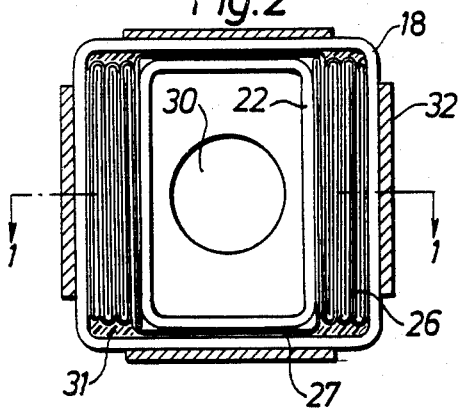
FIG. 2 is a cross section according to the line 2—2 in FIG. 1.
Figure 4:
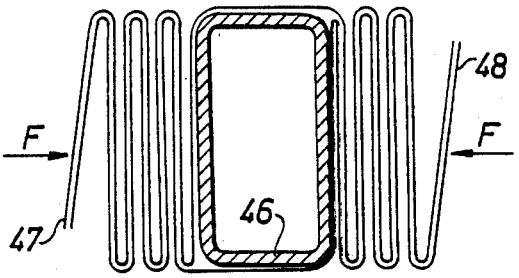
Figure 5:
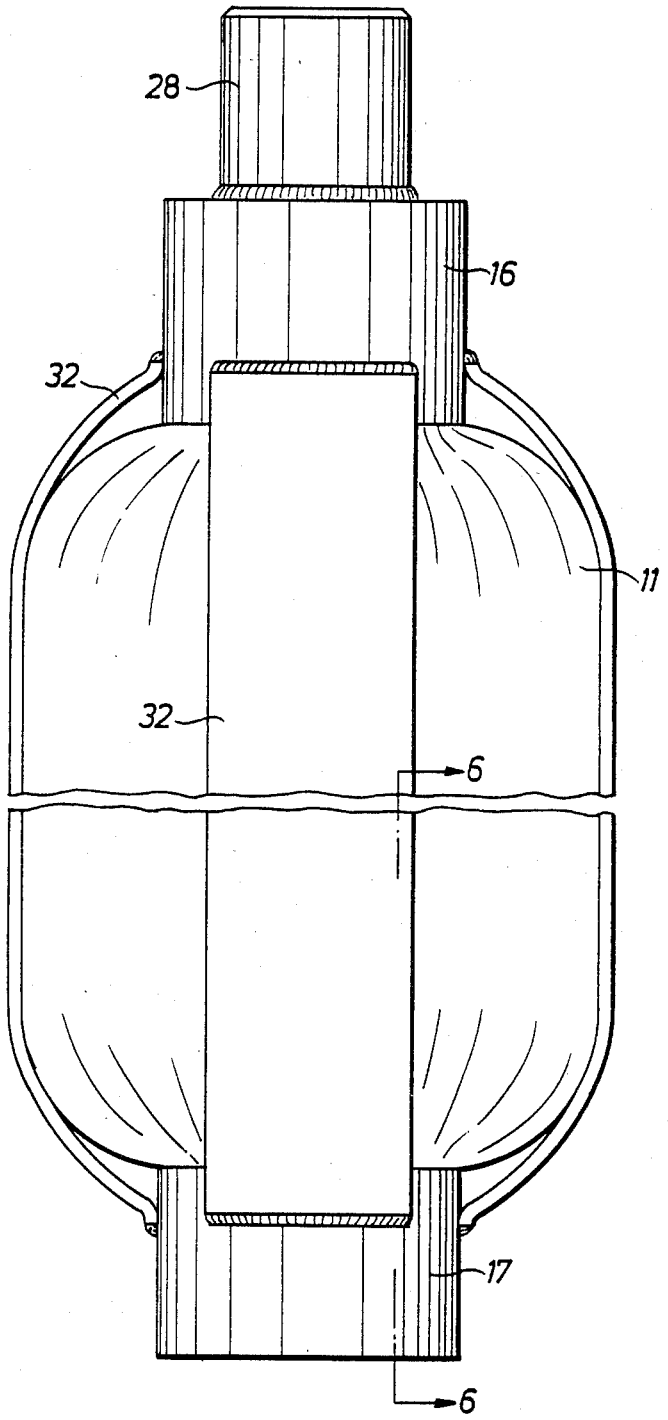
FIG. 5 is a side view of an expanded body according to FIG. 1.

The expansion body according to FIG. 1 includes a folded casing 11 and end closures 12, 13 arranged at the upper and lower end 14, 15 respectively of the casing 11. The casing 11 which is preferably made of sheet metal is folded in zig-zag shape in a way that appears from FIGS. 4 and 5 and will be described more in detail later on. In FIG. 1 the folds are only shown schematically. Each closure 12, 13 comprises a socket or end cap 16, 17 with a sleeve portion 18, 19 and a bottom portion 20, 21. The sleeves 18, 19 have preferably a square cross section in order to closely fit within a predrilled hole in the ground to provide for a high degree of expansion. The bottom portions 20, 21 in the form of square plates of steel are welded to the sleeves 18, 19 respectively for forming a sealed ending. Tubular spacing means 22 and 23 respectively are welded to each bottom plate 20, 21 to form part of the sockets 16, 17. They have a rectangular cross section and provide annular spaces 24, 25 between themselves and the sleeves 18, 19. The spaces 24, 25 are arranged for receiving the end parts 14 and 15 respectively of the casing 11 and each space 24, 25 comprises two wide parts 26 in which the casing is folded and two narrow parts 27 in which the casing is flat (FIG. 2).

The upper closure 12 includes a fitting 28 welded to the bottom plate 20 of the socket 16. The fitting 28 has an internal thread 29 for connection with a conduit in the form of a pipe, not shown, from an external source of pressurized fluid. The fluid, for example concrete, water or air is conveyed into the internal space of the casing through a passage 30 in the bottom plate. To prevent the fluid from leaking between the folds in the socket, a sealing agent 31 is arranged to fill up possible openings between the folds and between the end part 14, 15 of the casing and the socket 16, 17. The sealing agent 31 is preferably some viscous substance as for example asphalt but other substances can also be used for example different plastics.

Four connecting rods or plates 32 are welded to the sockets 16, 17 for retaining them on the casing ends when the pressurized fluid starts to unfold the casing. It might be sufficient with two rods 32 but it is preferred to have four so that the casing can be protected by them during handling, transportation and insertion in the ground especially when the expansion body is rammed into the ground instead of inserted into a pre-bored hole. The rods are adapted to follow the contour of the casing during the expansion of the body, see FIG. 5, and will thus bring the sockets 16, 17 closer to each other as the body shortens due to the expansion. Thus, the sockets 16, 17 need not be directly affixed to the respective ends of the casings.

In the embodiment described above, the expansion body is arranged to be the expanded end of a pile or anchor. The non-illustrated tube screwed to the fitting 28 forms the stem of the pile or anchor.

Reinforcing bars can be inserted through the stem and into the expansion body before concrete is forced into the tube to expand the expansion body and form an integral concrete anchor or pile that consists of a stem and a foot.

Several expansion bodies can be arranged on the same stem at desired axial intervals. The inner sleeves 22, 23 can then be dispensed with and the stem forming tube can have the same dimension as the sleeves 22, 23. The bottom plates 20 can be welded directly to the tube. The stem forming tube should then have several big holes into the expansion body for permitting concrete to pass into the expansion body and for providing sufficient concrete bridges between the concrete in the stem and the concrete in the expansion body.

It is also possible to arrange the expansion bodies on pre-formed concrete piles. The concrete for expanding the body or bodies can then be injected through a channel in the concrete pile or through conduits outside the pile.

In all the embodiments described, the pile or anchor with the expansion body or bodies thereon can be inserted into a pre-drilled hole in the ground or they can be forced into the ground. When they are forced into the ground, the bottom end should be provided with a shoe that can be formed as an arrow point.

Figure 3:
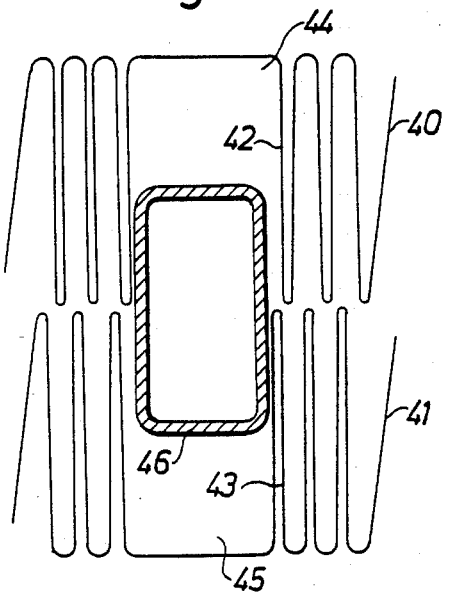
FIGS. 3 and 4 are a cross section of two sheets and a die beam, showing schematically the manufacture of the expansion body according to FIG. 1.

A preferred way of manufacturing the expansion body is to start with rolling an iron sheet to a zig-zag shaped sheet which is cut into smaller sheets of a suitable size. Two such sheets 40, 41, see FIG. 3, are laid over each other, face to face, so that the folds 42 of the first sheet 40 fall into the folds 43 of the second sheet 41. Along their middle portions, the sheets 40, 41 form an opening 44, 45 of about the same size as the spacing sleeves 22, 23. A die beam in the form of a box girder 46 with the same rectangular cross section as the spacing sleeves 22, 23 is arranged to be located in the opening 44, 45 when the two sheets are inserted in each other, see FIG. 4. FIG. 2 is somewhat misleading. The spacing sleeve 22 should have the same size in FIG. 2 as in FIG. 1.

The two longitudinal side edges 47, 48 are welded and the double sheet is pressed in a press, not shown, as indicated by the arrows F. The pressing is finished when the folds 42, 43 are in close abutment with each other, as in FIG. 2. Then the beam 46 is withdrawn from the internal space 49 established by the opening 44, 45 and the sleeves 18, 19 are put onto the ends of the casing 11. Then, the spacing sleeves 22, 23, to which bottom plates 20, 21 have been welded, are inserted into the internal space 49 and the bottom plates 20, 21 are welded to the sleeves 18, 19. The connecting rods 32 are then attached to the sleeves 18, 19 by welding and the ends of the expansion body are dipped into hot fluent asphalt which fills up and seals possible passages between each end part 14, 15 of the casing 11 and the respective socket 16, 17 as well as between the folds in the socket. The asphalt or other sealing agents penetrates also into the folds between the two sheets 40 and 41.

Figure 6:
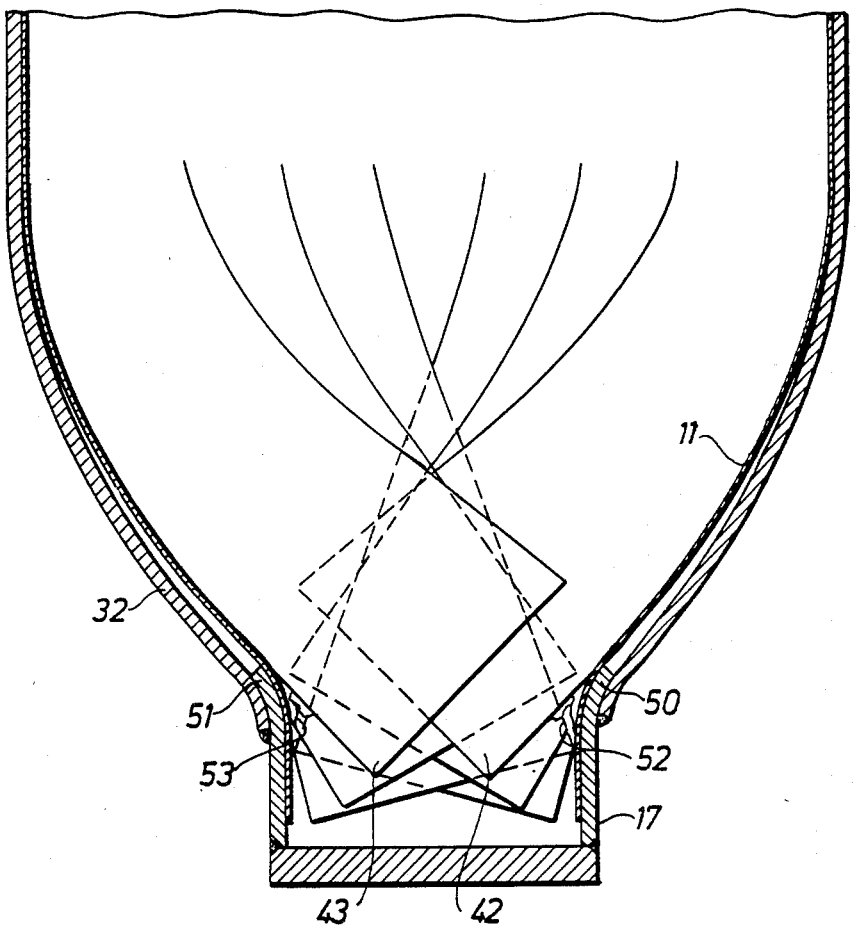
FIG. 6 is a cross section according to the line 6—6 in FIG. 5.
Figure 7:
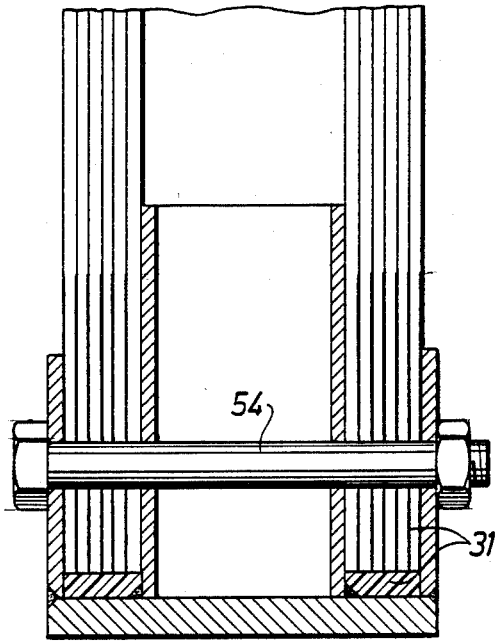
FIG. 7 is a longitudinal cross section of the lower end part of the casing with an alternative attachment between the closure and the casing.
Figure 8:
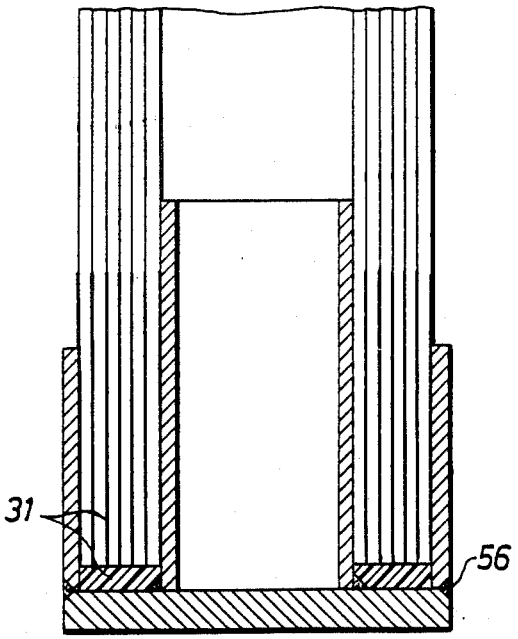
FIG. 8 is the same section as FIG. 7 but showing still another attachment.
Figure 9:
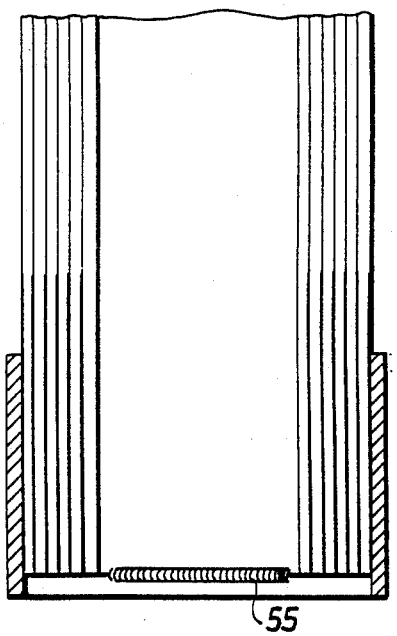
FIG. 9 shows the closure according to FIG. 8 partly finished.

The end closures 12, 13 so obtained are adapted for keeping the parts of the casing 11 which are located in the sockets 16, 17 in a folded position when the casing outside the sockets is unfolded and expanded. This is achieved since the folds are retained tightly adjacent to each other within the wide parts 26 of the spaces 24, 25 in the sockets. But it is also necessary to provide for some sliding motion in the sockets, otherwise extreme tensions will appear adjacent the sockets which tensions might cause the casing to crack. For that reason the space part 26 is wide enough to allow the folds of the two opposed sheets 40, 41 to move in opposite directions sliding against one another as can be seen in FIG. 6. The folds 42 and 43 of the first and second sheet 40 and 41 respectively turn about opposite edges 50 and 51 of the sleeves 18, 19 so that the edges bend somewhat outwards. The turning and sliding movement is longest for the folds which are located closest to the spacing tube 22 and it decreases successively towards the outer folds. The casing 11 may tear up close to the tubes 22 and 23 which results in slits 52, 53 as indicated in FIG. 6 but otherwise the casing 11 does not crack. The sliding movement is facilitated by the part of the sealing agent 31 which has penetrated inbetween the two sheets 40, The pressure needed for expanding the casing 11 varies with the formaton in which it is located. The pressure can typically be between a few bars and 50 bars depending on the depth and the formation. In application for which a comparatively low pressure is sufficient, the end closures 12, 13 can alternatively be attached directly to the end parts of the casing 11 as shown in FIGS. 7–9. In the embodiment according to FIG. 7 this is done by drilling a hole through the end caps 16, 17 and the casing 11 and inserting a bolt 54 in the hole. In another embodiment according to FIGS. 8 and 9 the end caps or sockets 16, 17 are welded to the ends of the casing by welding seam 55 between the sleeve portion of the socket and the part of the casing that is not folded. The welding seam 55 is applied to the inside of the sleeve as appears from FIG. 9 and the end cap is finished by welding the bottom plate to the wall portion by a welding seam 56, as can be see in FIG. 8.

It is to be understood that the invention is not limited to the disclosed examples but can be varied in many ways within the scope of the claims. For example the casing can be folded in other ways.

We claim:

1. An expansion body for constructions located in soil, comprising:

a longitudinally folded open-ended casing (11) having a plurality of folds surrounding an interior space thereof;

sockets (16, 17) on the ends of the casing;

connecting means (32) coupled between said sockets and extending along the outside of the casing;

said casing (11) and said sockets (16, 17) forming a closed chamber interior of said casing;

an inlet (28) connectable to a source to pressure fluid for pressurizing said closed chamber to expand and develop said folds of said casing between said sockets; and a sealing agent (31) in said sockets for preventing fluid leakage between said casing and said sockets.

2. The expansion body of claim 1, wherein the folding of said casing is such that said closed chamber is in the form of a substantially central space (49) extending between the sockets and zig-zag shaped narrow spaces extending laterally from said central space and surrounding said central space; and said sockets each comprise substantialy cylindrical spacers (22, 23) extending into said central space.

3. the expasnion body of claim 1, wherein said sockets each comprise a tube-shaped spacing means (22, 23) projecting substantially and parallel with the longitudinal length of said casing and into a central portion of said closed chamber.

4. The expansion body of claim 1, wherein said connecting means (32) comprises at least one connecting bar mounted to each of said sockets and extending between said sockets and opposite ends of said casing.

5. The expansion body of claim 4, comprising a plurality of said connecting bars spaced around said casing, a space being provided between respective adjacent connecting bars.

6. The expansion body of claim 5, wherein said connecting bars extend along the outside of said casing.

7. The expansion body of claim 1, wherein said connecting means extends along the outside of said casing.

8. The expansion body of claim 1, wherein said sockets (16, 17) each comprise an outer member (18, 19)

coupled to an outer portion of said casing, and an inner cylindrical spacer spaced inwardly from said outer members and extending into a central portion of said closed chamber, said casing being retained between said inner cylindrical spacers and said respective outer member.

9. an expansion body for constructions located in soil, comprising:

a longitudinally folded open-ended casing (11) having a plurality of folds surrounding an interior space thereof;

sockets (16, 17) on the ends of the casing;

means for retaining said sockets on the ends of said casing;

said casing (11) and said sockets (16, 17) forming a closed chamber interior of said casing;

an inlet (28) connectable to a source of pressure fluid for pressurizing said closed chamber to expand and develop said casing between said sockets; and a sealing agent (31) in said sockets for preventing fluid leakage between said casing and said sockets;

the folding of said casing being such that said closed chamber is in the form of a substantially central space extending between said sockets and zig-zag shaped narrow spaces extending laterally from said central space and surrounding said central space; and said sockets each comprising substantially cylindrical spacers (22, 23) extending into said central space.

* * * * *